US009770154B2

(12) United States Patent
Wilmes et al.

(10) Patent No.: US 9,770,154 B2
(45) Date of Patent: Sep. 26, 2017

(54) MOP COVER

(71) Applicant: CARL FREUDENBERG KG, Weinheim (DE)

(72) Inventors: Sabine Wilmes, Mannheim (DE); Karl-Ludwig Gibis, Limburgerhof (DE); Dieter Philipp, Schriesheim (DE); Christian Mast, Mannheim (DE); Lars Schmitt, Viernheim (DE); Susanne Walter, Gorxheimertal (DE)

(73) Assignee: CARL FREUDENBERG KG, Weinheim (DE)

( * ) Notice: Subject to any disclaimer, the term of this patent is extended or adjusted under 35 U.S.C. 154(b) by 0 days.

(21) Appl. No.: 14/786,554

(22) PCT Filed: Apr. 3, 2014

(86) PCT No.: PCT/EP2014/000887
§ 371 (c)(1),
(2) Date: Oct. 23, 2015

(87) PCT Pub. No.: WO2014/173493
PCT Pub. Date: Oct. 30, 2014

(65) Prior Publication Data

US 2016/0150939 A1 Jun. 2, 2016

(30) Foreign Application Priority Data

Apr. 25, 2013 (DE) ..... 10 2013 007 124
Jun. 5, 2013 (DE) ..... 10 2013 009 372

(51) Int. Cl.
*A47L 13/20* (2006.01)

(52) U.S. Cl.
CPC ..... *A47L 13/20* (2013.01)

(58) Field of Classification Search
CPC ..... A47L 13/20; A47L 13/16; A47L 13/256; A47L 13/12
See application file for complete search history.

(56) References Cited

U.S. PATENT DOCUMENTS 8,578,545 B2 * 11/2013 Wolf ..... A47L 13/254 15/118
2002/0065012 A1 * 5/2002 Takabayashi ..... A47L 13/16 442/381
2003/0077105 A1 4/2003 Hall et al.
2005/0081888 A1 * 4/2005 Pung ..... A47L 13/12 134/6
2007/0130713 A1 * 6/2007 Chen ..... A47L 13/16 15/209.1

(Continued)

FOREIGN PATENT DOCUMENTS

DE 19501201 A1 7/1996
DE 19907936 A1 9/1999

(Continued)

*Primary Examiner* — Shay Karls
(74) *Attorney, Agent, or Firm* — Leydig, Voit & Mayer, Ltd.

(57) ABSTRACT

A mop cover for cleaning surfaces, having a main body, configured and modified in such a way that the mop cover has an abrasive surface by which hairs and particles of dirt can be reliably picked up, wherein flock material is assigned to the main body, the flock material being disposed on a surface which can face a floor surface to be cleaned.

21 Claims, 6 Drawing Sheets

(56) References Cited

U.S. PATENT DOCUMENTS

| | | | | |
|---|---|---|---|---|
| 2009/0106924 | A1 | 4/2009 | Park | |
| 2009/0178223 | A1* | 7/2009 | Martin Rivera ..... | A47L 13/16<br>15/229.11 |
| 2012/0103078 | A1 | 5/2012 | Reimann et al. | |
| 2013/0283558 | A1 | 10/2013 | Gibis et al. | |

FOREIGN PATENT DOCUMENTS

| | | | |
|---|---|---|---|
| DE | 19834969 | A1 | 2/2000 |
| DE | 20305358 | U1 | 6/2003 |
| DE | 102006005984 | A1 | 8/2007 |
| DE | 102006055089 | A1 | 1/2008 |
| DE | 102009030658 | A1 | 12/2010 |
| DE | 102010054010 | A1 | 6/2012 |
| FR | 2875121 | A1 | 3/2006 |

* cited by examiner

MOP COVER

CROSS-REFERENCE TO RELATED APPLICATIONS

This application is a U.S. national stage application under 35 U.S.C. §371 of International Application No. PCT/EP2014/000887, filed on Apr. 3, 2014, and claims benefit to German Patent Applications No. DE 10 2013 007 124.0 and 10 2013 009 372.4, respectively filed on Apr. 25 and Jun. 5, 2013. The International Application was published in German on Oct. 30, 2014, as WO 2014/173493 A1 under PCT Article 21(2).

FIELD

The invention relates to a mop cover.

BACKGROUND

Mop covers for attaching to brackets or folding winglets are already known from the prior art. These brackets or folding winglets are attached to or articulated on a handle, so that cleaning of a floor, for example, may be readily carried out. The mop covers are pulled over the brackets or folding winglets.

A device which has a layer of flocked microfibers which is effective in cleaning is already known from DE 199 07 936 A1. The aforementioned device serves for removing pasty residues from printing screens, and may be disposed on a handling element. Flocked microfibers cannot particularly well retain crumbs, hairs and grainy dirt. Therefore, flocked microfibers are not particularly well suited to domestic or commercial cleaning tasks.

BRIEF SUMMARY

An aspect of the invention provides a mop cover for cleaning surfaces, the mop cover comprising: a main body including flocked material, wherein the flocked material is disposed on a mop surface capable of facing a floor surface to be cleaned.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
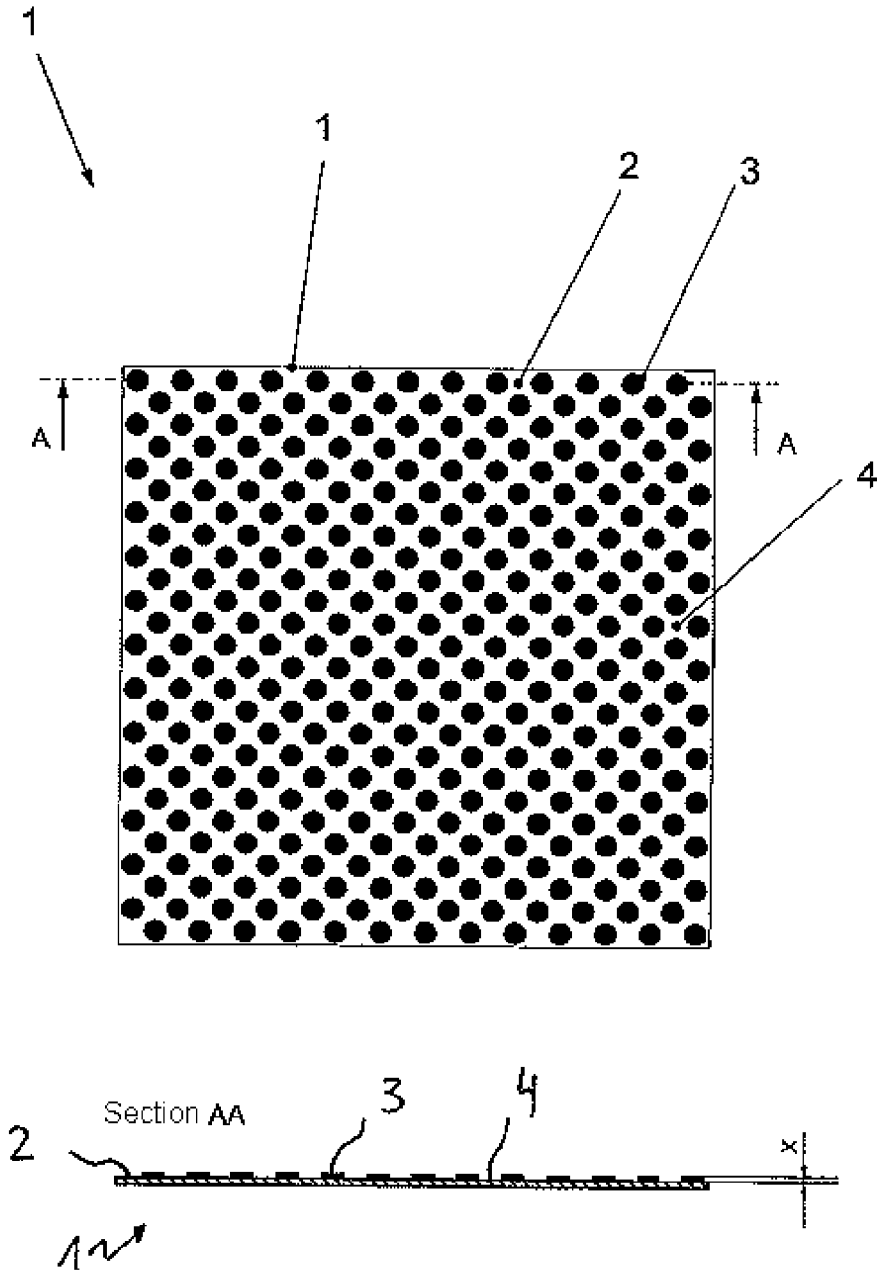
FIG. 1 in the upper view shows a plan view of a main body which is assigned flocked material which is disposed so as to be insular; and in the lower view shows a sectional view of the main body along the section line A-A.

Against this background, an aspect of the invention provides a mop cover of the type mentioned at the outset in such a manner that said mop cover has an abrasive surface by way of which hairs and dirt particles can be reliably picked up.

The present invention achieves the aforementioned object by way of the features of claims.

According to the invention, it has been recognized that a flocked material has comparatively hard and resistant fibers which can develop an abrasive effect. Persistent dirt may be released from the floor surface with the aid of the flocked material. Moreover, in the case of a suitable disposal of the flocked material it may be ensured that hairs, crumbs, dust particles, and/or dirt particles are picked up by the flocked material.

According to the invention it has been recognized that a comparatively soft main body may be provided by way of the flocked material with an abrasive property. It has been specifically recognized here that the advantages of the main body, namely the provision of a wide area, may be combined with the advantages of a hard surface, namely the flocked material.

Since the flocked coating is attached to the usual mopping area, the user may readily employ the flocked regions for removing dirt. The service life of the flocked coating is adapted to the service life of the main body, such that when the latter is replaced an original cleaning capability which is as good as new can be achieved again.

The flocked coating is applied to the main body. On account thereof, improved cleaning of the fibers of the flocked material is enabled when the mop cover is rinsed in water, since said fibers can move in relation to one another.

In comparison with a conventional mop cover, there is surprisingly an enormous increase in the cleaning capability in relation to the removal of persistent dirt, picking up hairs and particulate dirt. To this extent, a mop cover which achieves the object mentioned at the outset is provided.

The flocked material could not be designed as flocked microfibers. Flocked microfibers cannot particularly well retain crumbs, hairs and grainy dirt. Therefore, flocked microfibers are not particularly well suited to domestic or commercial cleaning tasks.

The flocked material could be disposed on a separate cleaning strip which in turn is fastened on the main body. The cleaning strip may be disposed on the edges, preferably on top, below, and/or laterally on the mop cover. The cleaning strip may also be disposed in the center of the mop cover.

The flocked material could be disposed so as to be insular and/or isolated in regions on the surface in such a manner that the latter is not covered by flocked material across its entire area. The insular disposal ensures that ducts or intermediate spaces, respectively, are created between individual islands of flocked material. Hairs and dirt particles may readily be picked up and entrained in these ducts or intermediate spaces.

The regionally isolated disposal of flocked material on the surface ensures that a sufficiently large area is not covered by flocked material. The surface which is not covered by flocked material is available for picking up liquid from a floor surface or for dispensing liquid onto the floor surface, respectively.

The flocked material could be disposed on the surface so as to be heart-shaped or V-shaped. On account of this irregular geometry of the islands of flocked material, the latter are particularly well able to develop their abrasive effect and to guide and direct dirt.

The flocked material could be present in the form of dots, waves, Vs, namely as the abbreviation for the "VILEDA" brand, or in the form of butterflies.

Against this background, the flocked material could comprise fibers and an adhesive matrix, wherein the fibers are inserted into the adhesive matrix in such a manner that free ends of the fibers protrude from the adhesive matrix. The fibers which are inserted into the adhesive matrix are very firmly connected to the adhesive matrix. Furthermore, the fibers are disposed so as to be very close to one another, such that they configure a comparatively hard bundle which develops abrasive effects. The free ends of the fibers may release persistent dirt from a floor surface. The free ends of the fibers may be guided like a brush on a floor surface.

The flocked material could have fibers of which the count is in the range of 20 to 100 dtex. It has surprisingly been found that fibers of this count are sufficiently stiff so as to develop an abrasive effect, but nevertheless sufficiently fine so as to pick up small dirt particles between them, like in a comb.

The flocked material could have fibers of which the protruding length is in the range of 1 to 3 mm. The protruding length is understood to be that region of a fiber that is not received in the adhesive matrix. On account of a protruding length of 1 to 3 mm, the fibers are sufficiently flexural, on the one hand, and sufficiently hard and brittle, on the other.

The fibers of the flocked material may be of different lengths. On account thereof, the pick-up of hairs is improved.

The cleaning strip could have a non-woven material. Non-woven materials are cost effective.

The cleaning strip could be composed of a warp-knitted fabric, a woven fabric, or a combination of a warp-knitted fabric and a woven fabric. Warp-knitted fabrics and woven fabrics are particularly stable.

The main body could have pockets, lugs, or clip elements. On account thereof, the mop cover is suitable for attaching to brackets or folding winglets. The brackets or folding winglets are attached to or articulated on a handle, so that cleaning of a floor, for example, may be readily carried out. The mop covers are pulled over the brackets or folding winglets. The brackets or folding winglets here may protrude into the pockets. The lugs or clip elements may engage around a bracket, so as to fix the mop cover on the bracket.

The mop cover could be designed as a flat mop cover. The flat mop cover has at least one cleaning strip, wherein the cleaning strip comprises at least one surface on which raised cleaning islands are disposed so as to be in each case spaced apart from one another, and wherein the cleaning islands on all sides are enclosed by storage spaces for receiving contaminants.

The main body could be assigned two types of flocked material, wherein the two types are spatially separated from one another. On account thereof, the mop cover may pick up various types of dirt.

Against this background, a first flocked material could not be designed as flocked microfibers and a second flocked material could be designed as flocked microfibers, the fibers of which are in the range below 1 dtex. Flocked microfibers can particularly well retain very fine particles. Therefore, the mop cover is suitable for both picking up comparatively coarse dirt as well as comparatively fine dirt.

At least two different cleaning strips could be provided, wherein a first cleaning strip supports a first flocked material, and a second cleaning strip supports a second flocked material. By means of the cleaning strips the flocked materials may readily be sewn onto the main body.

At least two different cleaning strips could be provided, wherein at least one cleaning strip supports a flocked material, and a further cleaning strip supports a woven fabric, warp-knitted fabric, a velours fabric, or a non-woven material. On account thereof, further textiles may be combined with a flocked material of flocked microfibers or not of flocked microfibers.

Against this background, three different cleaning strips could be provided, wherein a first cleaning strip supports a first flocked material, a second cleaning strip supports a second flocked material, and a third cleaning strip supports a woven fabric, warp-knitted fabric, a velours fabric, or a non-woven material. In this way, particularly many types of dirt can be picked up.

At least one cleaning strip could be folded around one or a plurality of outside edges of the mop cover, preferably be sewn around an outside edge. On account thereof, one outside edge or a plurality of outside edges is/are created from which flocked material or another textile material which is suitable for cleaning protrudes. By way of such an outside edge, dirt on a plinth or in joints can be removed, for example. Furthermore, the flocked materials protrude from the main body on both sides of the mop cover. Flocked material is not only provided on that side that faces the floor surface to be cleaned, but also on the opposite side.

FIG. 1 shows a main body 1 which has a surface 2 on which flocked material 3 is disposed so as to be insular. The flocked material 3 is disposed in circular islands.

The flocked material 3 is disposed so as to be insular and/or isolated in regions on the surface 2 in such a manner that the latter is not covered by flocked material 3 across its entire area. The flocked material 3 configures intermediate spaces 4.

Figure 2A:
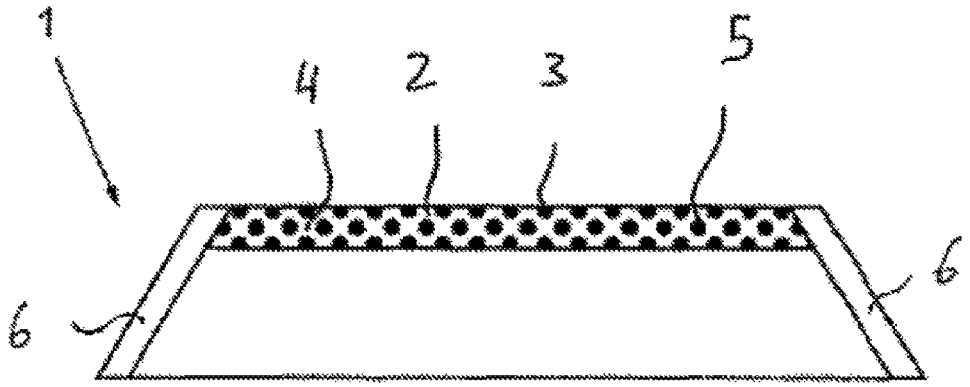
FIG. 2 in the upper view shows a plan view of a trapezoidal mop cover which has a cleaning strip having flocked material only on the shorter longitudinal side; in the central view shows a plan view of a trapezoidal mop cover which has one cleaning strip having flocked material on each of two parallel longitudinal sides; and in the lower view shows a plan view of a trapezoidal mop cover which has a cleaning strip having flocked material only on the longer longitudinal side.
Figure 2B:
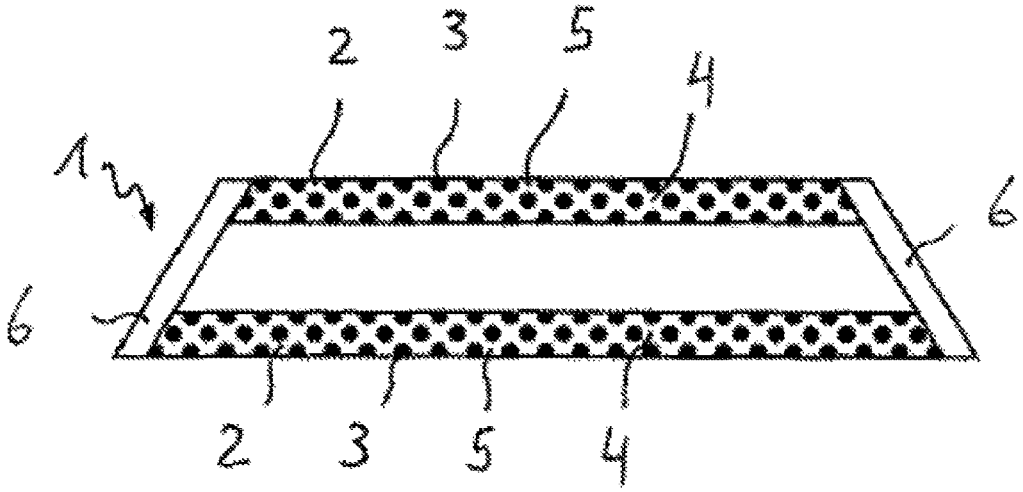
Figure 2C:
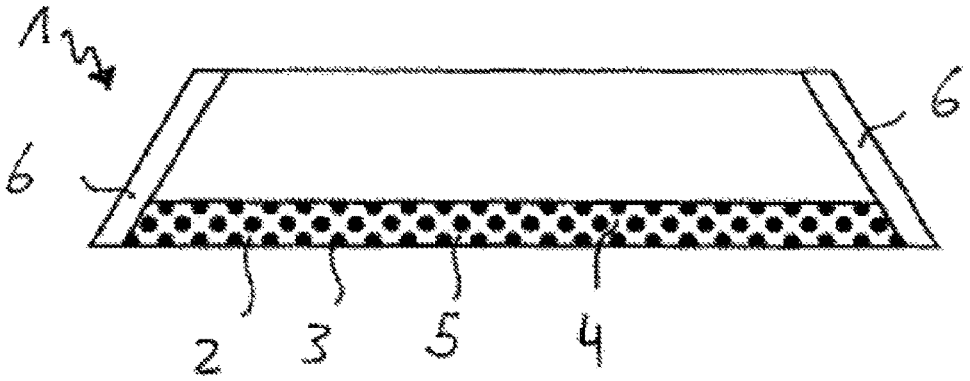

FIG. 2 in the upper view shows a mop cover for cleaning surfaces, comprising a main body 1, wherein the main body 1 is assigned flocked material 3, and wherein the flocked material 3 is disposed on a surface 2 which is capable of facing a floor surface to be cleaned. The main body 1 is configured so as to be trapezoidal.

The flocked material 3 is not designed as flocked microfibers. The flocked material 3 is disposed on a separate cleaning strip 5 which in turn is fastened on the main body 1.

A single cleaning strip 5 which is disposed on the shorter of the parallel longitudinal sides is provided.

The flocked material 3 is disposed so as to be insular and/or isolated in regions on the surface 2 in such a manner that the latter is not covered by flocked material 3 across its entire area.

FIG. 2 in the central view shows a mop cover for cleaning surfaces, comprising a main body 1, wherein the main body 1 is assigned flocked material 3, and wherein the flocked material 3 is disposed on a surface 2 which is capable of facing a floor surface to be cleaned. The main body 1 is configured so as to be trapezoidal.

The flocked material 3 is not designed as flocked microfibers. The flocked material 3 is disposed on two separate cleaning strips 5 which are fastened on the main body 1.

Two individual cleaning strips 5 which are disposed on the parallel longitudinal sides are provided.

The flocked material 3 is disposed so as to be insular and/or isolated in regions on the surface 2 in such a manner that the latter is not covered by flocked material 3 across its entire area.

FIG. 2 in the lower view shows a mop cover for cleaning surfaces, comprising a main body 1, wherein the main body 1 is assigned flocked material 3, and wherein the flocked material 3 is disposed on a surface 2 which is capable of facing a floor surface to be cleaned. The main body 1 is configured so as to be trapezoidal.

The flocked material 3 is not designed as flocked microfibers. The flocked material 3 is disposed on a separate cleaning strip 5 which is fastened on the main body 1.

A single cleaning strip 5 which is disposed on the longer of the parallel longitudinal sides is provided.

The flocked material 3 is disposed so as to be insular and/or isolated in regions on the surface 2 in such a manner that the latter is not covered by flocked material 3 across its entire area.

Figure 3:
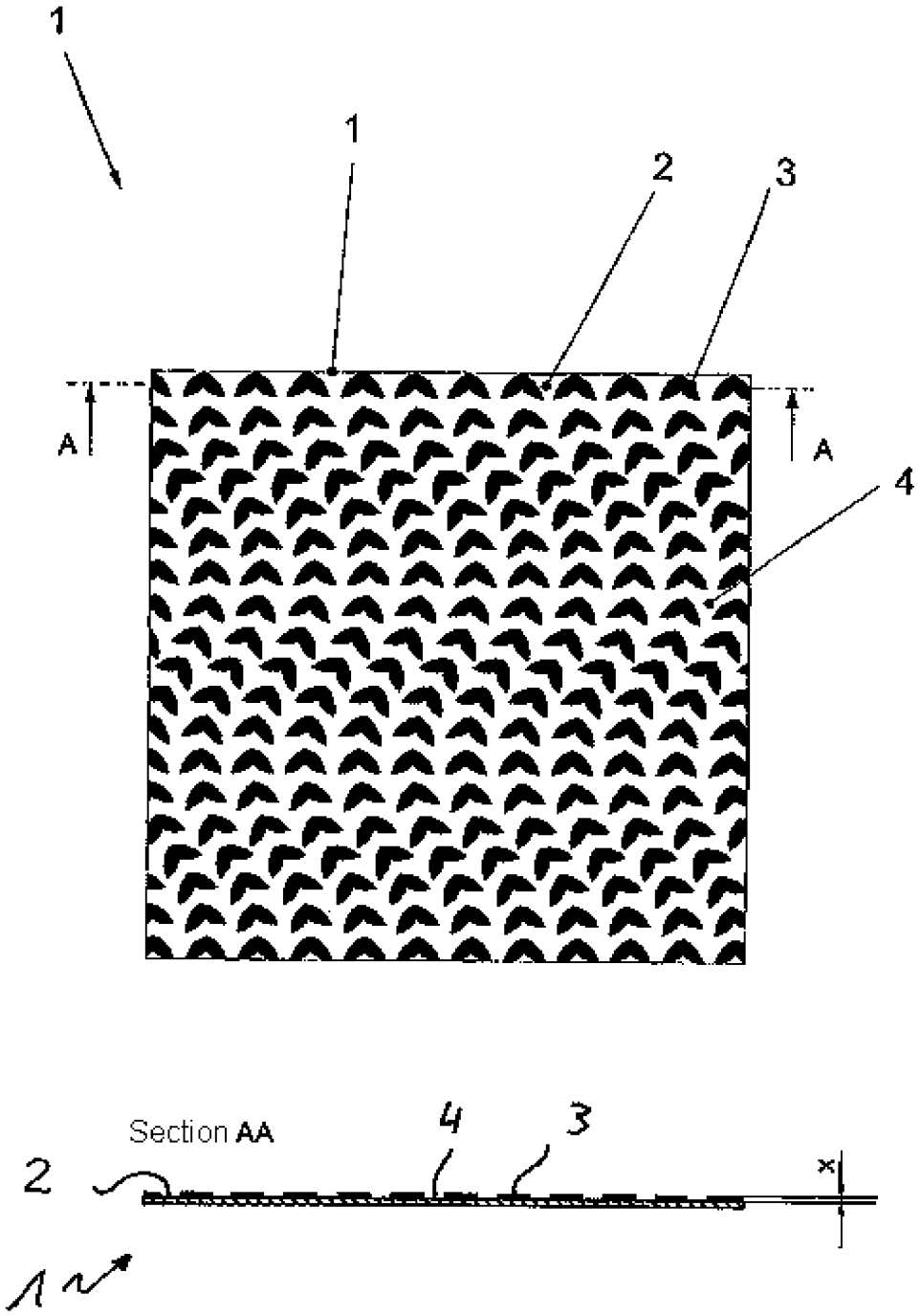
FIG. 3 in the upper view shows a plan view of a main body which is assigned flocked material which is disposed so as to be insular, wherein the islands are designed so as to be substantially heart-shaped; and in the lower view shows a sectional view of the main body along the section line A-A.

FIG. 3 shows a main body 1 which has a surface 2 on which flocked material 3 is disposed so as to be insular. The flocked material 3 is disposed in the form of heart-shaped islands.

The flocked material 3 is disposed so as to be insular and/or isolated in regions on the surface 2 in such a manner that the latter is not covered by flocked material 3 across its entire area. The flocked material 3 configures intermediate spaces 4.

The flocked material 3 is disposed on the surface 2 so as to be heart-shaped or V-shaped.

Figure 4:
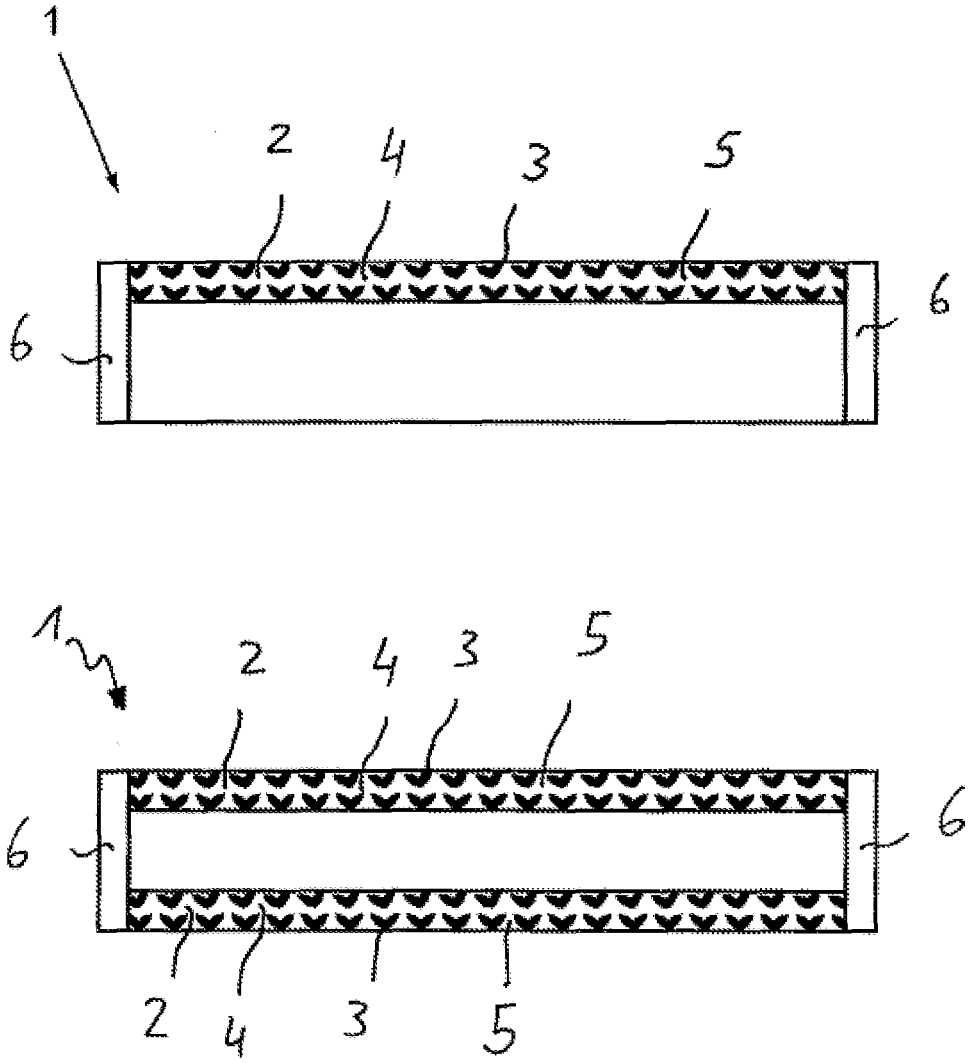
FIG. 4 in the upper view shows a plan view of a rectangular mop cover which has a cleaning strip having flocked material only on one longitudinal side; and in the lower view shows a plan view of a rectangular mop cover which on both longitudinal sides each has one cleaning strip having flocked material.

FIG. 4 in the upper view shows a mop cover for cleaning surfaces, comprising a main body 1, wherein the main body 1 is assigned flocked material 3, and wherein the flocked material 3 is disposed on a surface 2 which is capable of facing a floor surface to be cleaned. The main body 1 is configured so as to be rectangular.

The flocked material 3 is not designed as flocked microfibers. The flocked material 3 is disposed on a separate cleaning strip 5 which in turn is fastened on the main body 1.

A single cleaning strip 5 which is disposed on one of the parallel longitudinal sides is provided.

The flocked material 3 is disposed so as to be insular and/or isolated in regions on the surface 2 in such a manner that the latter is not covered by flocked material 3 across its entire area. The flocked material 3 is disposed in the form of heart-shaped islands.

FIG. 4 in the lower view shows a mop cover for cleaning surfaces, comprising a main body 1, wherein the main body 1 is assigned flocked material 3, and wherein the flocked material 3 is disposed on a surface 2 which is capable of facing a floor surface to be cleaned. The main body 1 is configured so as to be rectangular.

The flocked material 3 is not designed as flocked microfibers. The flocked material 3 is disposed on two separate cleaning strips 5 which are fastened on the main body 1.

Two individual cleaning strips 5 which are disposed on the parallel longitudinal sides are provided.

The flocked material 3 is disposed so as to be insular and/or isolated in regions on the surface 2 in such a manner that the latter is not covered by flocked material 3 across its entire area. The flocked material 3 is disposed in the form of heart-shaped islands.

In FIGS. 1 to 4, the flocked material 3 comprises fibers and an adhesive matrix, wherein the fibers are inserted into the adhesive matrix in such a manner that free ends of the fibers protrude from the adhesive matrix. The flocked material 3 has fibers which are in the range of 20 to 100 dtex. The flocked material 3 has fibers of which the protruding length is in the range of 1 to 3 mm.

A cleaning strip 5 has a non-woven material or is made of a non-woven material.

A cleaning strip 5 may also be composed of a warp-knitted fabric, woven fabric, or a combination of a warp-knitted fabric and a woven fabric.

In FIGS. 2 and 4, the main bodies 1 each have two pockets 6. Brackets or folding winglets may be introduced into the pockets 6 and, on account thereof, the mop cover may be clamped in place. These brackets or folding winglets are attached to or articulated on a handle, so that cleaning of a floor, for example, may be readily carried out. The mop covers are pulled over the brackets or folding winglets.

Instead of the pockets, 6, or additionally thereto, other means by way of which the mop cover can be tied to the brackets or winglets may be provided. The means may comprise lugs or clip elements.

Figure 5:
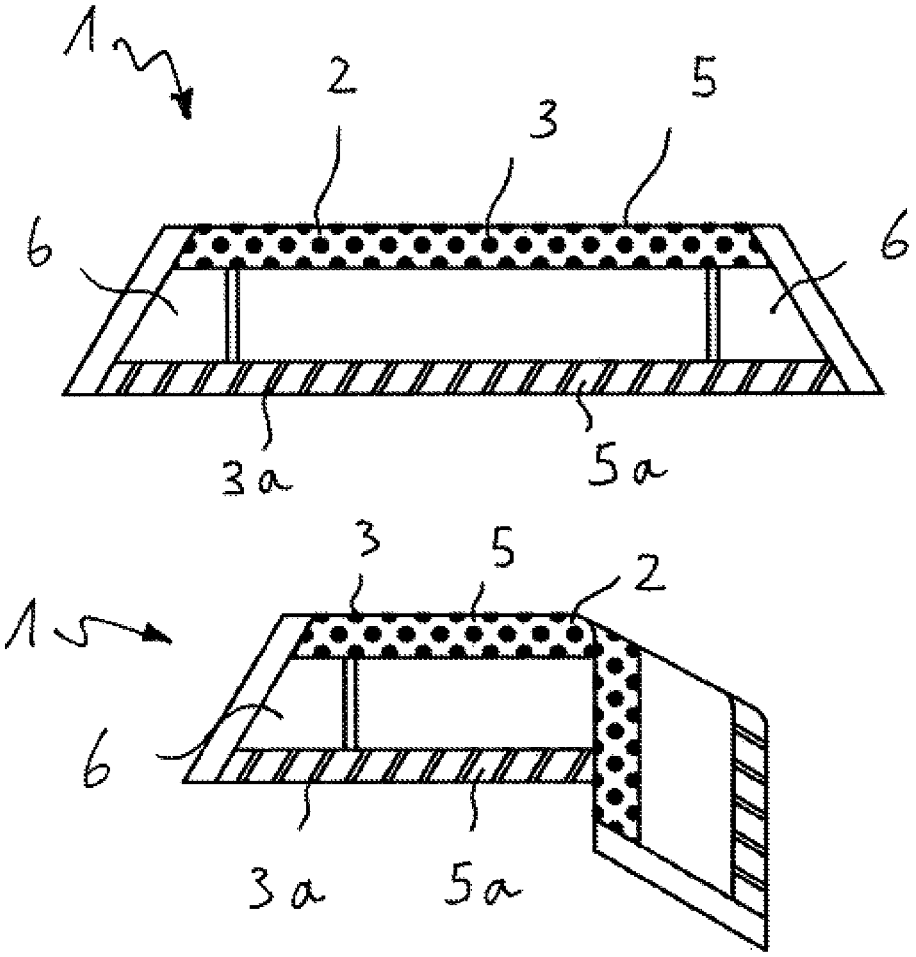
FIG. 5 in the upper view shows a plan view of a trapezoidal mop cover which on the shorter longitudinal side has a first cleaning strip having a first flocked material, and on the longer longitudinal side has a second cleaning strip having a second flocked material; and in the lower view shows the aforementioned mop cover in a state in which it is partially folded over.
Figure 6:
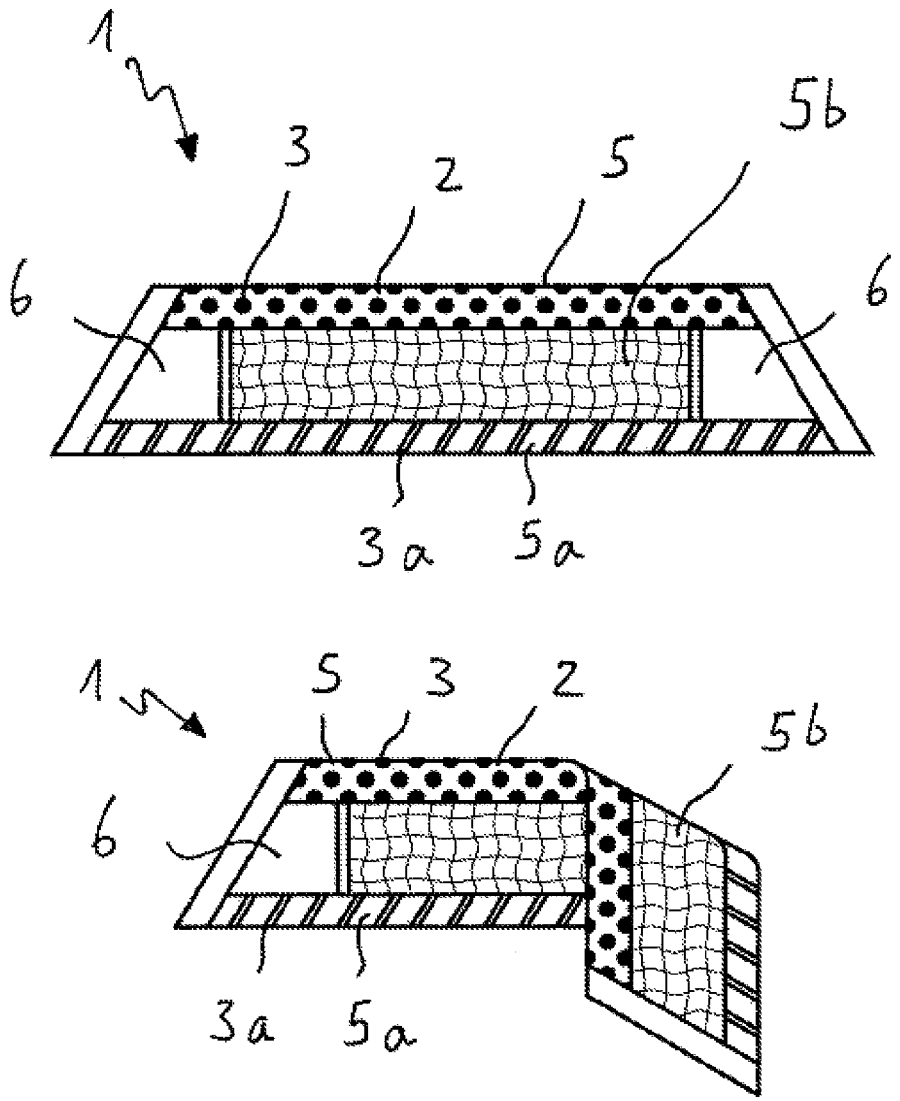
FIG. 6 in the upper view shows a plan view of a trapezoidal mop cover which on the shorter longitudinal side has a first cleaning strip having a first flocked material, on the longer longitudinal side has a second cleaning strip having a second flocked material, and in the center has a further, third cleaning strip having a textile material; and in the lower view shows the aforementioned mop cover in a state in which it is partially folded over.

FIGS. 5 and 6 show mop covers in which the main body 1 is assigned two types of flocked material 3, 3*a*, wherein the two types are spatially separated from one another.

A first flocked material 3 is not designed as flocked microfibers and a second flocked material 3*a* is designed as flocked microfibers, the fibers of which are in the range below 1 dtex.

At least two different cleaning strips 5, 5*a* are provided, wherein a first cleaning strip 5 supports a first flocked material 3, and a second cleaning strip 5*a* supports a second flocked material 3*a*.

In FIG. 6 at least two different cleaning strips 5, 5*a*, 5*b* are provided, wherein at least one cleaning strip 5, 5*a* supports a flocked material 3, 3*a*, and a further cleaning strip 5*b* supports a woven fabric, warp-knitted fabric, a velours fabric, or a non-woven material. Specifically, three different cleaning strips 5, 5*a*, 5*b* are provided, wherein a first cleaning strip 5 supports a first flocked material 3, a second cleaning strip 5*a* supports a second flocked material 3*a*, and a third cleaning strip 5*b* supports a woven fabric, warp-knitted fabric, a velours fabric, or a non-woven material.

The cleaning strips 5, 5*a* are folded around the longer outside edges of the mop cover. Specifically, the cleaning strips 5, 5*a* are sewn around the outside edges.

The flocked materials 3, 3*a* protrude from the main body 1 on both sides.

In FIGS. 5 and 6, the main bodies 1 each have two pockets 6. Brackets or folding winglets may be introduced into the pockets 6 and, on account thereof, the mop cover may be clamped in place. These brackets or folding winglets are attached to or articulated on a handle, so that cleaning of a floor, for example, may be readily carried out. The mop covers are pulled over the brackets or folding winglets.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A mop cover for cleaning surfaces, the mop cover comprising:

a main body including a strip including islands of flocked material including a plurality fibers disposed in an adhesive matrix such that free ends of the fibers protrude from the adhesive matrix, wherein the strip includes intermediate spaces disposed between the islands of flocked material, wherein the strip of flocked material is disposed such that, when the mop cover is disposed on a mop, the strip is arranged on at least one outer periphery of a main body surface facing a floor surface to be cleaned, wherein the strip is a separate cleaning strip, wherein the separate cleaning strip is fastened on the main body, wherein the strip is disposed on at least a front edge or a rear edge of the at least one outer periphery.

2. The cover of claim 1, wherein the flocked material does not include flocked microfibers.

3. The cover of claim 1, wherein at least one of the islands of flocked material is disposed on the main body surface so as to be heart-shaped.

4. The cover of claim 1, wherein the flocked material includes fibers which are in a range of from 20 to 100 dtex.

5. The cover of claim 1, wherein the fibers have a protruding length in a range of from 1 to 3 mm.

6. The cover of claim 1, wherein the cleaning strip includes a non-woven material.

7. The cover of claim 1, wherein the cleaning strip includes a warp-knitted fabric, woven fabric, or a combination of a warp-knitted fabric and a woven fabric.

8. The cover of claim 1, wherein the main body includes a pocket, a lug, or a clip element.

9. The cover of claim 1, wherein the main body includes a first flocked material and a second flocked material, wherein the first flocked material is different from the second flocked material, and wherein the first and second flocked material are spatially separated from one another.

10. The cover of claim 9, wherein the first flocked material is not flocked microfibers, and wherein the second flocked material is flocked microfibers, the microfibers of which are in a range below 1 dtex.

11. The cover of claim 1, comprising:

a first cleaning strip; and a second, different cleaning strip, wherein the first cleaning strip supports a first flocked material, and wherein the second cleaning strip supports a second flocked material.

12. The cover of claim 1, comprising:

a first cleaning strip; and a second, different cleaning strip, wherein at least one cleaning strip supports the flocked material, and wherein a further cleaning strip supports a woven fabric, warp-knitted fabric, a velours fabric, or a non-woven material.

13. The cover of claim 1, comprising:

a first cleaning strip;

a second cleaning strip; and a third cleaning strip, wherein the first, second, and third cleaning strips are different from each other, wherein the first cleaning strip supports a first flocked material, wherein the second cleaning strip supports a second flocked material, and wherein the third cleaning strip supports a woven fabric, warp-knitted fabric, a velours fabric, or a non-woven material.

14. The cover of claim 1, wherein at least one cleaning strip is folded around one or a plurality of outside edges of the mop cover.

15. The cover of claim 1, wherein at least one of the islands of flocked material is disposed on the main body so as to be V-shaped.

16. The cover of claim 1, comprising the flocked material on at least a front periphery of the main body surface.

17. The cover of claim 1, comprising the flocked material on a front and rear periphery of the main body surface, the main body surface having a rectangular or trapezoidal shape having two side peripheries and the front and rear periphery.

18. The cover of claim 1, wherein the flocked material is only peripherally arranged of the main body surface.

19. The cover of claim 1, wherein the flocked material is arranged as circular, heart-shaped, V-shaped, butterfly-shaped, or irregular shaped islands.

20. The cover of claim 1, having no flocked material disposed in a center of the mop cover.

21. The cover of claim 1, wherein flocked material is not only provided facing the floor surface to be cleaned, but also on an opposite side to the floor surface.

* * * * *